US006357140B1

(12) United States Patent
Heyer et al.

(10) Patent No.: US 6,357,140 B1
(45) Date of Patent: Mar. 19, 2002

(54) APPARATUS FOR DRYING SUBSTANTIALLY ELLIPSOID PRODUCTS, SUCH AS FOR INSTANCE EGGS

(75) Inventors: Jan Heyer, Barneveld; Ad van Pinxteren, Eemnes, both of (NL)

(73) Assignee: FPS Food Processing Systems B.V. (NL)

( * ) Notice: Subject to any disclaimer, the term of this patent is extended or adjusted under 35 U.S.C. 154(b) by 0 days.

(21) Appl. No.: 09/606,208

(22) Filed: Jun. 29, 2000

(51) Int. Cl.[7] ..... F26B 19/00

(52) U.S. Cl. ..... 34/236; 34/216; 34/217; 34/501; 34/502

(58) Field of Search ..... 34/236, 216, 217, 34/232, 233, 240, 69, 70, 71, 500, 501, 502, 266, 267, 92, 378

(56) References Cited

U.S. PATENT DOCUMENTS

| | | | | |
|---|---|---|---|---|
| 3,589,028 A | * | 6/1971 | Hinton | 34/236 |
| 3,972,127 A | * | 8/1976 | Hoshi et al. | 34/266 |
| 4,173,831 A | | 11/1979 | McCord | |
| 4,189,849 A | * | 2/1980 | Van der Schoot | 34/236 |
| 4,750,277 A | | 6/1988 | Kuhl | |
| 4,777,734 A | * | 10/1988 | Elferink | 34/236 |
| 4,985,956 A | * | 1/1991 | Van der Schoot | 34/217 |
| 5,548,905 A | * | 8/1996 | Kuma et al. | 34/92 |
| 5,581,907 A | * | 12/1996 | Kuma et al. | 34/216 |
| 5,596,815 A | * | 1/1997 | Rice et al. | 34/378 |
| 6,125,549 A | * | 10/2000 | Pikus | 34/267 |

FOREIGN PATENT DOCUMENTS

| | | |
|---|---|---|
| JP | 3-2134 | 1/1991 |

* cited by examiner

*Primary Examiner*—Teresa Walberg
*Assistant Examiner*—Fadi H. Dahbour
(74) *Attorney, Agent, or Firm*—Larson & Taylor, PLC

(57) ABSTRACT

Apparatus for drying substantially ellipsoid products, such as, for instance, eggs, which are conveyed over a conveying path by a conveyor. The apparatus includes a number of nozzles which are connected to a compressor. The nozzles are designed and arranged relative to the conveying path, such that the drying air blown out by these nozzles has a main flow direction which is both directed substantially perpendicularly to the surface of a passing product and blows directly onto at least the areas adjacent the points of a passing product.

32 Claims, 7 Drawing Sheets

APPARATUS FOR DRYING SUBSTANTIALLY ELLIPSOID PRODUCTS, SUCH AS FOR INSTANCE EGGS

BACKGROUND OF THE INVENTION

This invention relates to an apparatus for drying substantially ellipsoid products which are conveyed over a conveying path by means of a conveyor, the apparatus comprising a first number of nozzles which are connected to a compressor.

In some countries, it is mandatory to wash eggs before they are packed. Moreover, some packers believe that the impression of hygiene and quality is enhanced when eggs, before being packed, are washed, so that manure and feathers are removed from the eggs. After washing the eggs, it is important that the eggs be dried as soon as possible. In fact, when drying is deferred too long, the moisture with which the eggs have been washed migrates through the porous shell and thus affects the taste and/or the quality of the egg. It may also be advantageous to wash ellipsoid products other than eggs, for instance fruit.

For drying eggs, various apparatuses are known, which apparatuses are described in, for instance, U.S. Pat. No. 4,173,831, U.S. Pat. No. 4,750,277 and JP-U-3-2134.

In these known apparatuses, the dry air is blown down from above, perpendicularly to the plane of conveyance. A drawback of the known apparatuses is that after the ellipsoid products have passed a first number of nozzles in a first drying section, moisture still remains on the conveyor. Because of the fact that the conveyors are mostly roller conveyors, and the ellipsoid products are rotated over at least some parts of the conveyor path, the moisture on the conveyor rollers is spread again over the substantially dried ellipsoid products. As a consequence the drying result is not satisfactionary. A further drawback of the known apparatuses is that in order to achieve an acceptable drying result, a huge amount of air needs to be blown onto the eggs Upon visual inspection of the eggs dried with the known apparatuses, a dried surface percentage of about 70% is observed. A flow rate of 1500 $m^3$ per 10,000 eggs per hour, with the pressure being about 50 mbar (5,000 Pa) at the outflow slots, is not unusual in the known apparatuses. In a machine in which twelve rows of eggs are conveyed side by side, with a capacity of 10,000 eggs per row per hour, this requires a power of 54 kW. According to standardized measurements, the noise level produced as a result of the large amount of air being blown out is certainly 95–105 dB (A), which makes it necessary to encase the entire drier. Such a large amount of drying air which is blown down vertically above the eggs with a fairly low pressure leads to the drying result of about 70%, which in itself is little satisfactory. In particular at the points of an egg, that is, at the opposite ends with the highest degree of curvature, there is a substantial chance that moisture will remain present there after the egg has passed the drier.

SUMMARY OF THE INVENTION

The object of the invention is to adapt the apparatus of the type described in the opening paragraph hereof , such that it no longer has the above-described disadvantages. To that end, the invention provides an apparatus for drying substantially ellipsoid products which are conveyed over a conveying path by means of a conveyor, the apparatus comprising a first number of nozzles which are connected to a compressor forming a first drying section, wherein at least one rotating brush is arranged under the conveyor such that the at least one brush contacts an underside of the conveyor for removing water therefrom.

Water which has been blown off from the ellipsoidal products and which is still remaining on the conveyor will be removed by the at least one brush which is rotating under the conveyor such that it wipes off water from the conveyor. Especially, when the conveyor is a roller conveyor of which the rolls rotate at least over a certain part of the conveyor path the presence of the brush is of the utmost importance in order to avoid that water which has been blown off again is spread over the ellipsoidal products. A roller conveyor is particularly favorable because the products can be rotated as they pass the nozzles, which yields a greater product surface exposed to direct blowing action.

According to a further elaboration of the invention, a wipe bar arranged parallel to the brush may be present such that brush hairs of the brush wipe against the wipe bar for wiping off the water from the brush.

The apparatus may be provided with two drying sections for achieving a better drying result. To further improve the drying result suction openings may be provided under the conveyor, which suction openings are connected to a suction pump for creating a reduced pressure under the conveyor. Water drips hanging at the under side of the ellipsoid products can be removed by these suction openings.

According to a further elaboration of the invention, the nozzles may be designed and arranged relative to the conveying path such that the drying air blown out by these nozzles has a main flow direction which is both directed substantially perpendicularly to the surface of a passing product and blows directly onto at least the areas adjacent the points of a passing ellipsoid product. As a result of the fact that the nozzles blow the drying air substantially perpendicularly to at least those surface portions of a passing product that are located adjacent the points of the passing product, at the points of the product which are difficult to dry, still an excellent drying result is obtained. The term 'points'is herein understood to refer to those portions of the ellipsoid product where the curvature of the surface is strongest, i.e., essentially the positions where the longitudinal axis of the ellipsoid product intersects the surface of the product. Substantially halfway the two points on the: longitudinal axis lies the center of the egg. The nozzles are designed and arranged such that the drying air blown out by them is directed substantially at the middle of a passing product and also blows directly upon the areas adjacent the points of the product. In that way, upon visual inspection, a dried surface percentage of at least about 90% is observed.

According to a further elaboration of the invention, the surface exposed to direct blowing can be further enlarged when the rollers, for the purpose of their rotation, are driven such that the movement of the upwardly facing side of the products, which movement occurs as a result of the rotation, has a direction which is equal to the conveying direction of the conveyor.

It is then preferred when, according to a further elaboration of the invention, the rotational speed of the rollers and the distance of the nozzles are adjusted to each other such that each product, after passing the nozzles, does not have any shell surface portion, at least adjacent the points of the product, that has not been directly blown upon by drying air from one of the nozzles.

BRIEF DESCRIPTION OF THE DRAWINGS

Further elaborations of the invention are defined in the subclaims and will hereinafter be further clarified on the basis of an exemplary embodiment, with reference to the drawings.

DETAILED DESCRIPTION OF THE PREFERRED EMBODIMENT

Figure 5:
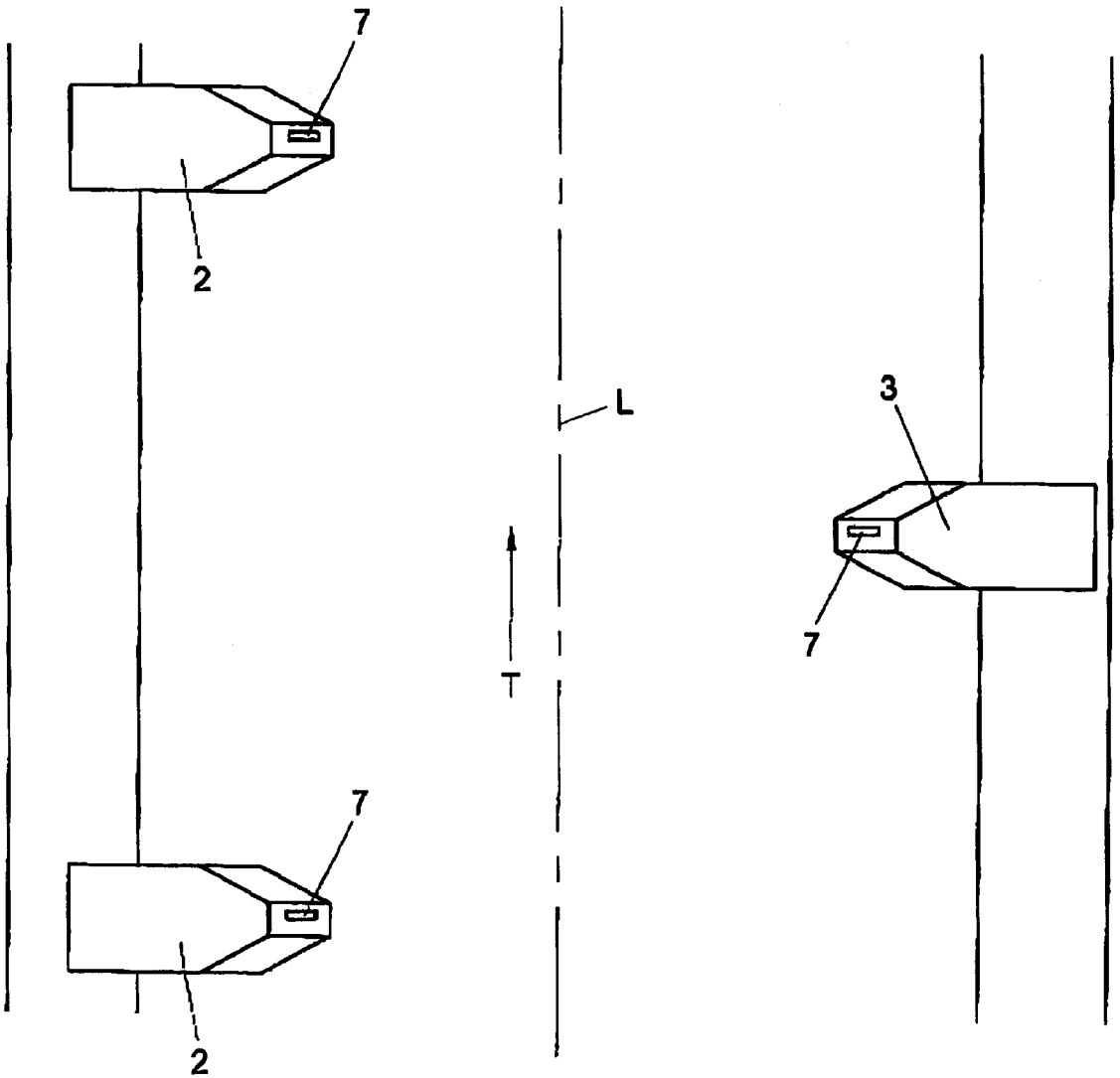
FIG. 5 shows a detail of a bottom view of a part of the drying section which is arranged above a conveyor.

The exemplary embodiment of an apparatus according to the invention comprises a roller conveyor 1 provided with shafts 5 on which rollers 6 are mounted. The shafts 5 are advanced in a conveying direction T by means of chains with which the shafts 5 are rotatably connected. The rollers 6 are located at a mutual distance such that the rollers 6 in pairs enclose a nest in which one egg E is receivable. Typically, a shaft 5 carries a plurality of rollers 6 mounted side by side, so that in the conveying direction T a number of rows of eggs extend along a conveying path L. These conveying paths L are represented by a centerline in FIG. 1 and FIG. 5. Arranged above the conveyor 1 are nozzles 2, 3 which are connected to a compressor. In the present exemplary embodiment, the nozzles 2, 3 are connected with lines 10 extending in the conveying direction T. The ends of the lines 10 are connected with a transverse line 11, 12 which are each connected to a supply 13, 14 by means of which compressed air is supplied.

In the present exemplary embodiment, an opposite sides obliquely above each row of rollers of the roller conveyor 1 extending in the conveying direction T, nozzles 2, 3 are arranged. The main flow direction D of the drying air blown out by the nozzles 2, 3 includes an angle $\alpha$ with the rotation axis 5 of the rollers 6, which is in the range of 10°–85°. The angle a and the main flow direction D are clearly represented in FIG. 4. It will be clear that the exemplary embodiment is given by way of example. Also when the angle $\alpha$ is about 10°, an excellent drying result can be obtained. As a result of this arrangement, the drying air blown out by these nozzles 2, 3 has a main flow direction which is directed substantially perpendicularly to the shell S of a passing egg E. Because the nozzles 2, 3 are arranged on opposite sides, obliquely above each row of rollers 6 of the roller conveyor 1, in particular the areas adjacent the points P of a passing egg E are directly blown upon. Thus, an excellent drying of the point areas P of the egg E, which are generally difficult to reach, is accomplished.

Figure 3:
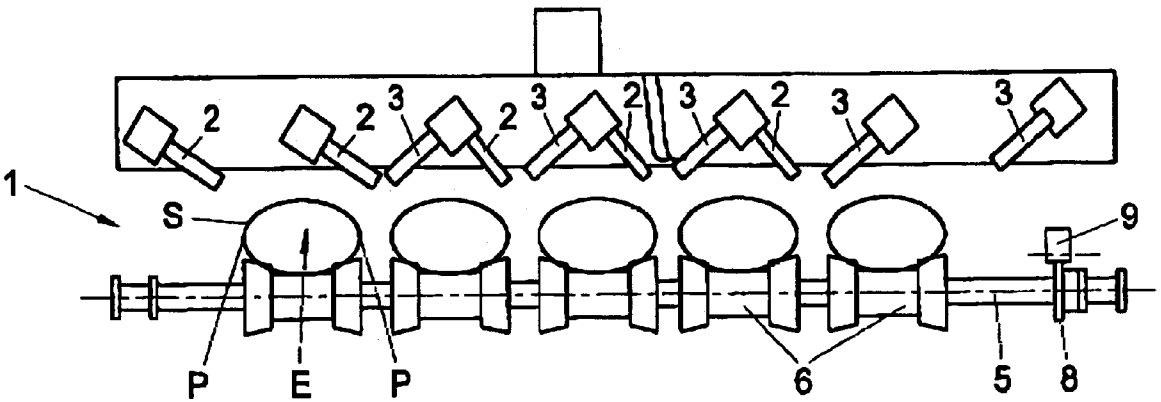
FIG. 3 shows a cross-sectional elevation taken on the line III—III in FIG. 1.
Figure 4:
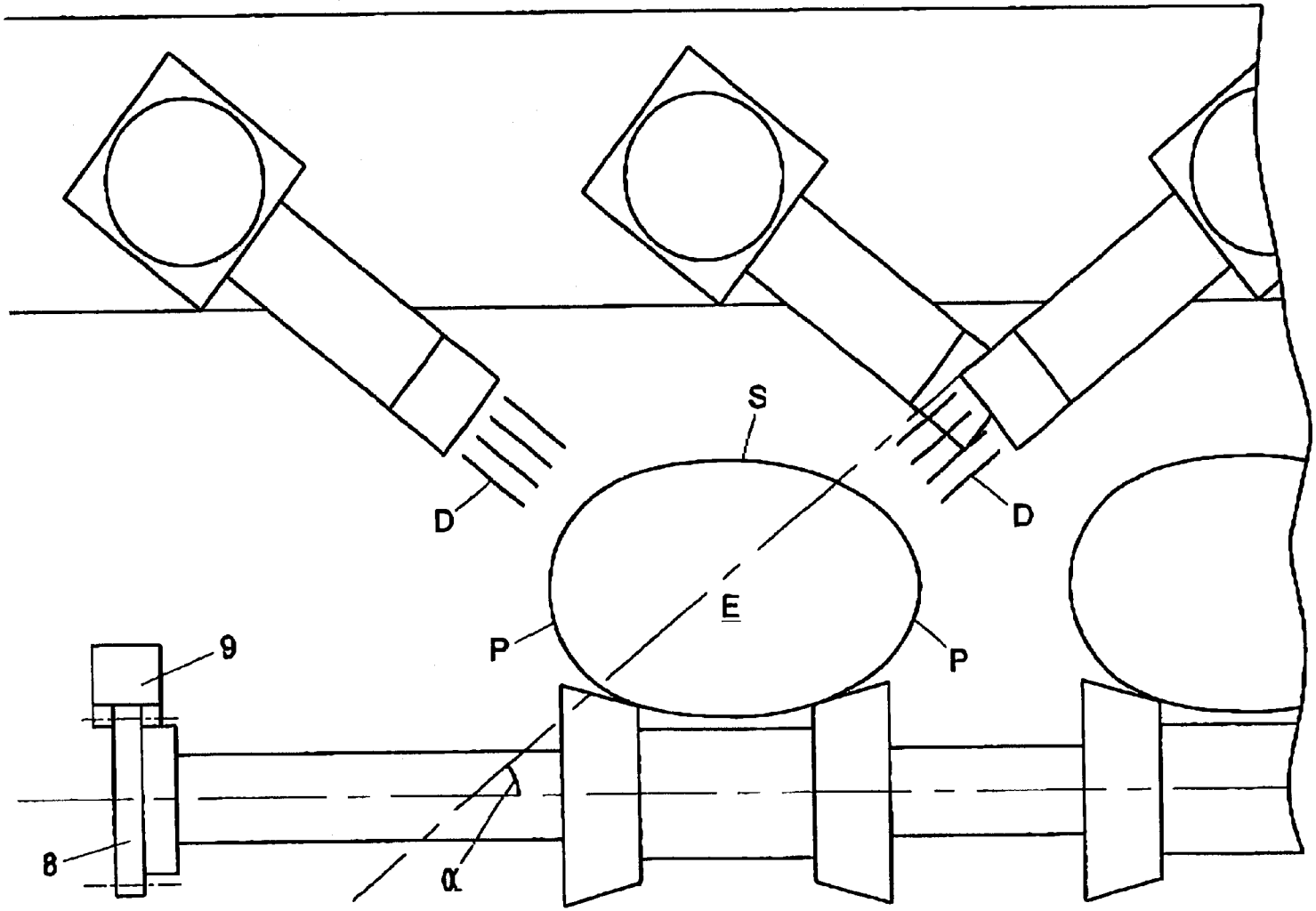
FIG. 4 shows a detail of a cross-sectional elevation as represented in FIG. 3.

FIGS. 3 and 4 clearly show that the shaft 5 carrying the rollers 6 further comprises a gear wheel 8. The conveyor 1, at least adjacent the drying apparatus, is provided with a gear rack 9 which engages the upwardly facing side of the gear wheels 8. As a result of the presence of the gear wheels 8 and the gear rack 9 engaging the upper side of the gear wheels 8, the rollers 6 will rotate during the conveyance through the drying apparatus. The direction of this rotation is such that the top side of the eggs E has the same direction of movement as the conveyor 1. As a consequence, the shell surface S of the eggs exposed to direct blowing by the nozzles 2, 3 as the eggs pass a nozzle 2, 3 is considerably enlarged. The rotational speed of the rollers is preferably adjusted to the distance between the nozzles 2, 3, as viewed in the conveying direction, such that each egg E, after passing the nozzle 2, 3, does not have any shell surface portion S, at least adjacent the points P, that has not been directly blown upon by drying air from one of the nozzles.

Figure 1:
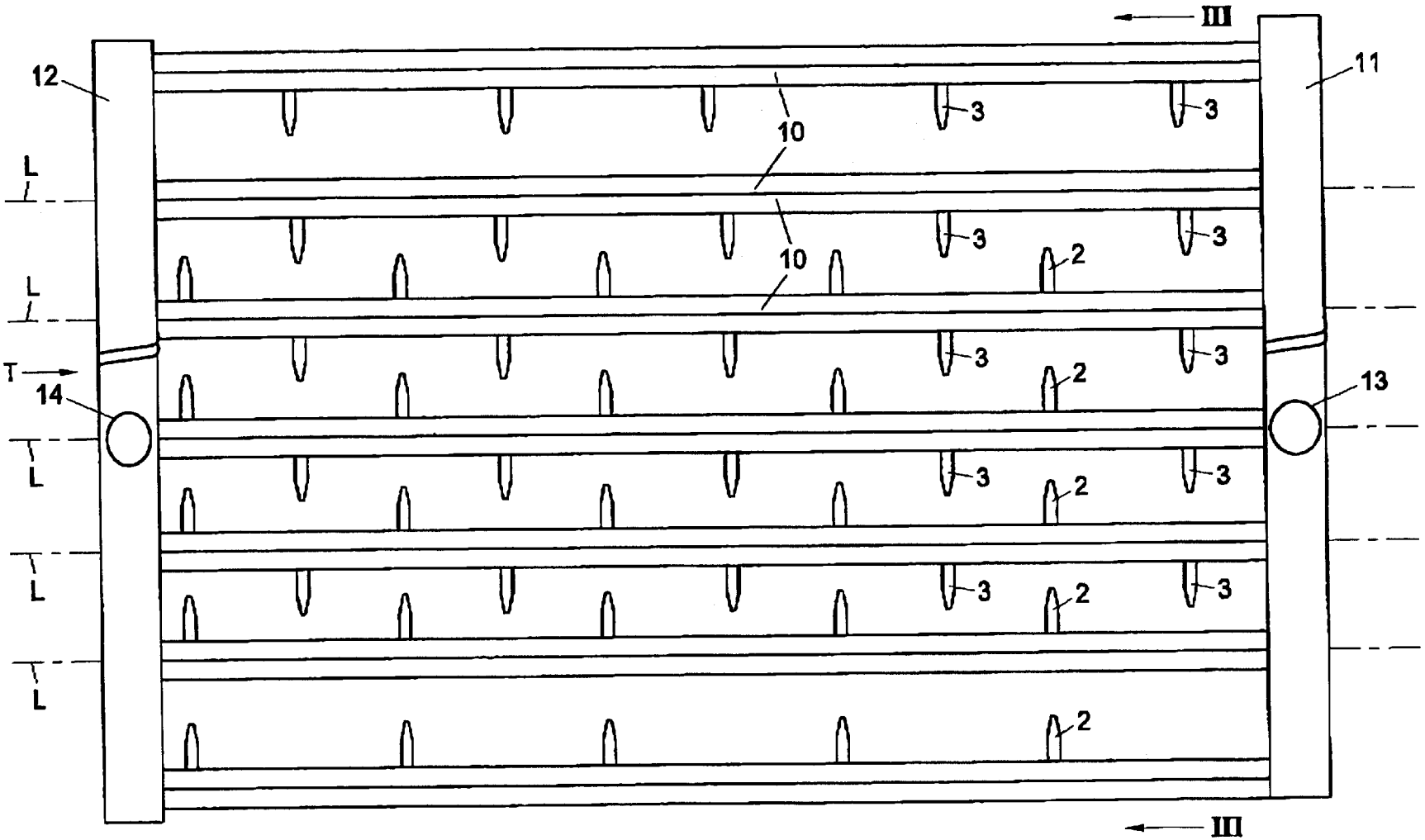
FIG. 1 shows a top plan view of a drying section, with omission of the conveyor arranged under it.

As is clearly represented in FIG. 1, the nozzles 2 which, viewed in the conveying direction T, are arranged on the left above a row of rollers 6, are arranged so as to be staggered in the conveying direction T relative to the nozzles 3 which, viewed in the conveying direction T, are arranged on the right above a given row of rollers G. What is prevented as a result of this staggered arrangement is that the air flow directed to the right, coming from the nozzles 3, disturbs the air flow directed to the left, coming from the nozzles 2. The reason is that such a disturbance might adversely affect the extent of drying that is accomplished. As appears clearly from the top plan view represented in FIG. 1, in case the conveyor 1 comprises a plurality of rows of rollers 6 extending in the conveying direction T, it is particularly favorable when the nozzles 2, 3 which are in one line viewed in a direction transverse to the conveying direction T and parallel to the plane of conveyance all blow to the same side, while the nozzles 2, 3 succeeding each other in the conveying direction and located in one line in transverse direction, alternately blow to the left and to the right. Such a design prevents the dry air from nozzles 2, 3 of different rows of rollers 6 from disturbing each other, which might also lead to an adverse effect on the drying action of the apparatus.

Figure 2:
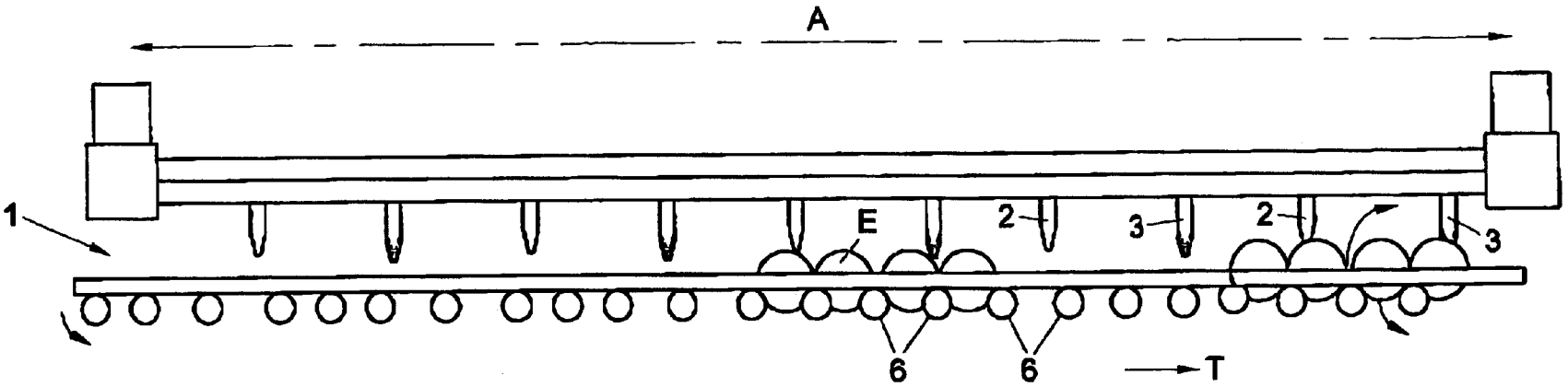
FIG. 2 shows a side elevation of the drying section represented in FIG. 1.

In contrast to the known apparatuses, in the present apparatus, a much lower flow rate of drying air has been chosen. In the present exemplary embodiment, the amount of drying air blown out by the nozzles 2, 3 is about 150 $m^3$ per 10,000 eggs per hour. The nozzles 2, 3 are arranged relatively freely and each comprise a substantially rectangular outflow opening 7 of about 1×10 mm. Optionally, the slits can have a slightly deviant form, for instance a lesser width halfway the outflow opening 7. Because the nozzles 2, 3 are freely arranged, air from above the nozzles 2, 3 can be entrained with the drying air blown out by the nozzles 2, 3. The free arrangement moreover results in a lower noise level. The substantially rectangular outflow opening 7 is clearly visible in the bottom view of FIG. 5 of a portion of the drying apparatus, where, for the sake of clarity, the drying line 10, which is arranged straight above the row of rollers 6 which traverses the conveying path L, has been omitted since that line 10 is intended for an adjacent row of rollers. The longitudinal direction of the outflow opening 7 lies in an imaginary vertical plane which extends perpendicularly to the conveying direction T of the conveyor 1. With outflow openings 7 of such design, an excellent drying result is obtained when the overpressure of the drying air to be blown out is in the range of at least about 100 mbar (=10,000 Pa). Partly as a result of this considerably higher overpressure than was conventional in the prior art, and the considerably lower flow rate, upon visual inspection an excellent drying result of at least about 90% is dry surface is observed, with the noise level being relatively low (about 80 decibels). As a consequence of the much lower noise level, the encasing which the prior art apparatuses necessitated can be omitted in the apparatus according to the invention FIGS. 1 and 2 represent a single drying section. In order to obtain an optimum drying result, it is particularly favorable when the nozzles 2, 3 are arranged in two drying sections above the conveyor, while between these sections, viewed in the conveying direction T, there is a certain distance, which is such that the water still present after the first drying section is redistributed over the eggs E. In the second drying section, this redistributed water can be removed. The above-mentioned optimum drying result is obtained, for instance, when the length A of the drying sections, viewed in the conveying direction T, is about 800 mm, the distance between the two drying sections being about 500 mm.

Optionally, the apparatus may comprise a heating element arranged for heating the drying air to be blown out by the nozzles. In that way, the moisture absorbing capacity of the drying air is further increased. Further, optionally, under the conveyor 1 suction openings could be provided which are connected to a suction pump for the purpose of creating a reduced pressure under the conveyor 1. Such a reduced pressure stimulates the evaporation of moisture and hence the drying of the eggs.

Figure 6:
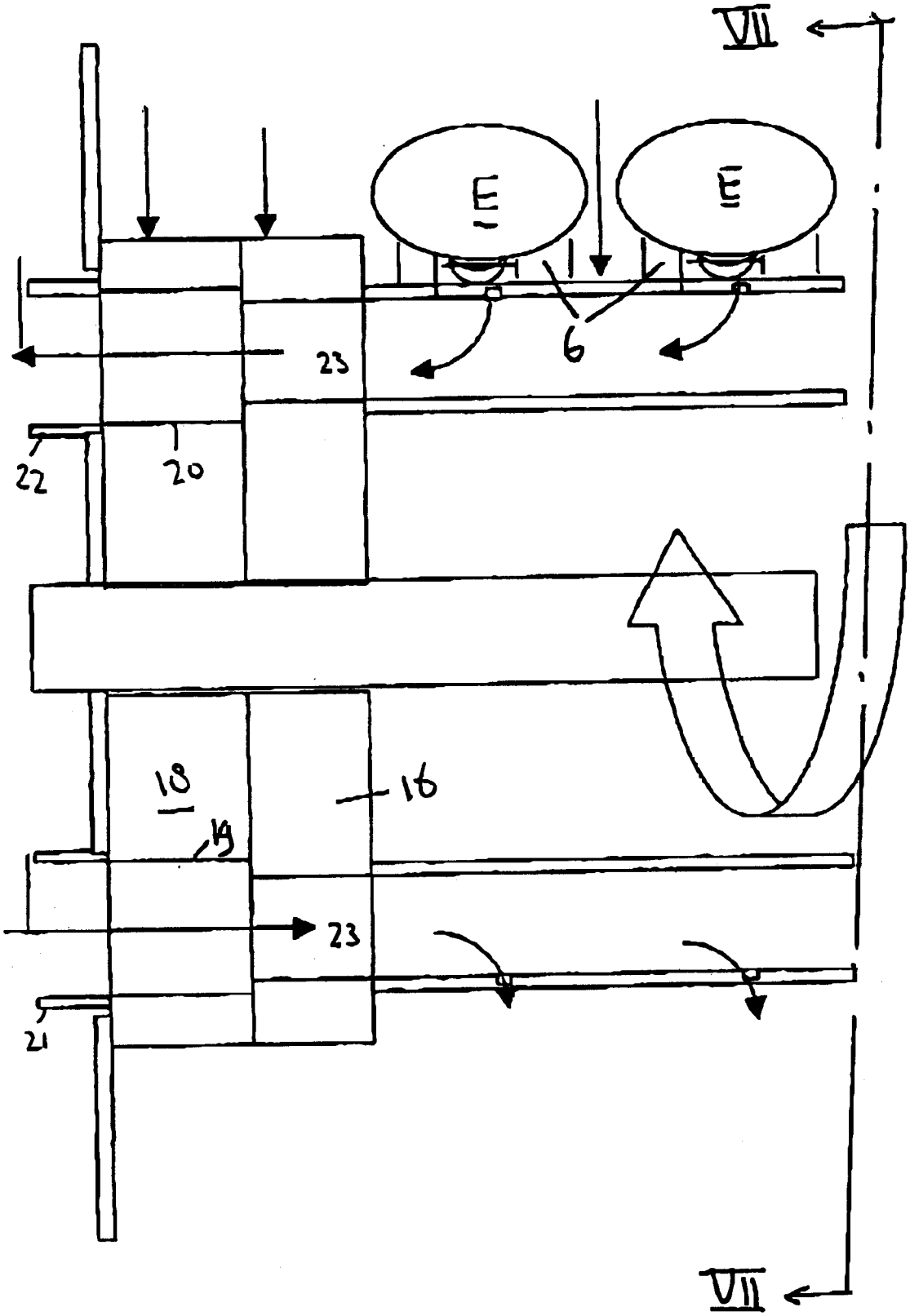
FIG. 6 shows a left-hand portion of a drop extraction unit.
Figure 7:
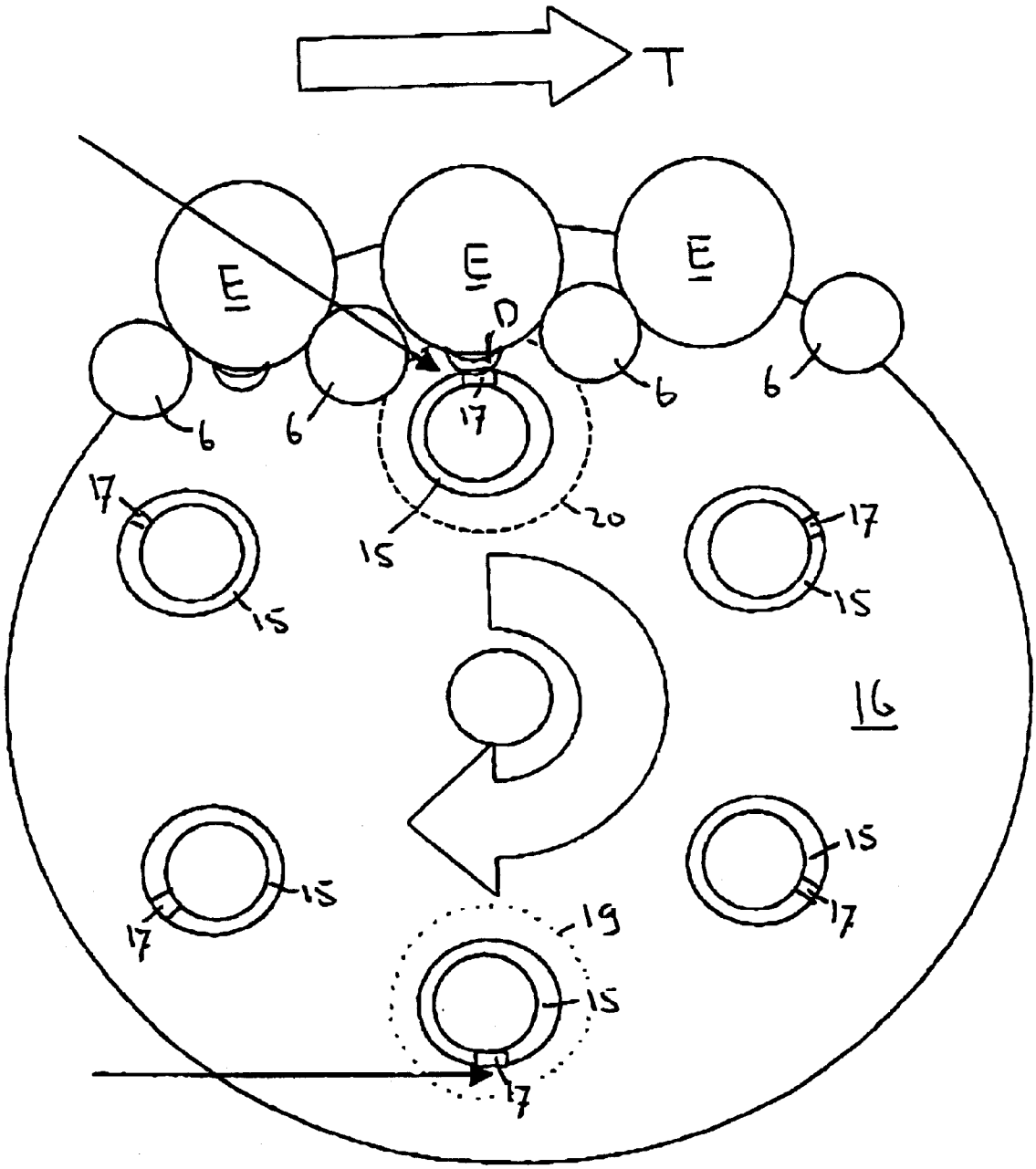
FIG. 7 shows a cross-sectional elevation, taken on the line VII—VII in FIG. 6, of the drop extraction unit.

In some cases, there is a chance that a drop of moisture adheres to the underside of the eggs. FIGS. 6 and 7 show partly schematic elevations of a drop extraction unit which may be arranged under the rollers 6 of the conveyor 1. The drop extraction unit comprises a number of tubes 15 each having their ends connected with two discs 16 which are rotatably arranged. The tubes 15 are located on a pitch circle at regular angular distances from each other, the center of this pitch circle coinciding with the center of rotation of the rotatable disc 16. FIG. 6 shows only the left portion of the drop extraction unit, the view being against the conveying direction T of the conveyor 1. In the tubes 15, on the radially outward sides thereof, openings 17 are provided via which air can be drawn in or blown off. For the purpose of discharging and optionally supplying air to the interior of the tube 15, stationary discs 18 are arranged next to the rotatable discs 16. These stationary discs 18 are provided with two openings 19, 20 which are connected to an overpressure air source and a reduced pressure air source, respectively, for instance the pressure and suction line of an air compressor. Provided in the rotary discs 16 are bores 23 which pass through the disc 16 and terminate in the interior of the tubes 15. When during rotation a bore 23 passes the opening 19 or the opening 20 in the stationary disc, this creates an overpressure and a reduced pressure, respectively, in the tube 15 in question. As a result, air will be blown out via the openings 17 or be drawn into the tube 15. As is clearly visible in FIG. 7, the pressure opening 19 in the disc 18 is in a lower position, while the suction opening 20 in the stationary disc 18 is in an upper position. Accordingly, when a tube 15 rotates into the upper position, a reduced pressure will be created therein, yielding an air flow from the outside via the opening 17 in the direction of the interior of the tube 15 in question. Because the tube 15 moves just below the surface of the conveyor 1, the suction opening 17 is located quite close to the underside of an egg E disposed on the conveyor 1. A drop D, if any, which clings to the underside of the egg E is then sucked from the egg E via the opening 17. The drop D ends up in the interior of the tube 15 which rotates further. When the tube 15 enters the lower region of the circle it traverses, the interior of the tube 15 is brought into fluid communication with the pressure opening 19 in the stationary disc 18. As a result, air present in the tube 15 is blown away via the openings 17 while entraining any moisture present in the tube 15.

For driving the rotatable disc 16, a separate driving motor can be utilized. It is preferred, however, when the drive of the rotatable discs 16 is coupled with the drive of the conveyor 1. This can be simply done, for instance, by providing the rotatable discs 16 with a gear wheel profile having such dimensions that the shafts 5 on which the rollers 6 are mounted can cooperate therewith. In that way, the conveyor 1 drives the rotatable discs 16, so that the position of the tubes 15 is always fixed relative to the shafts 5 of the conveyor 1.

Figure 8:
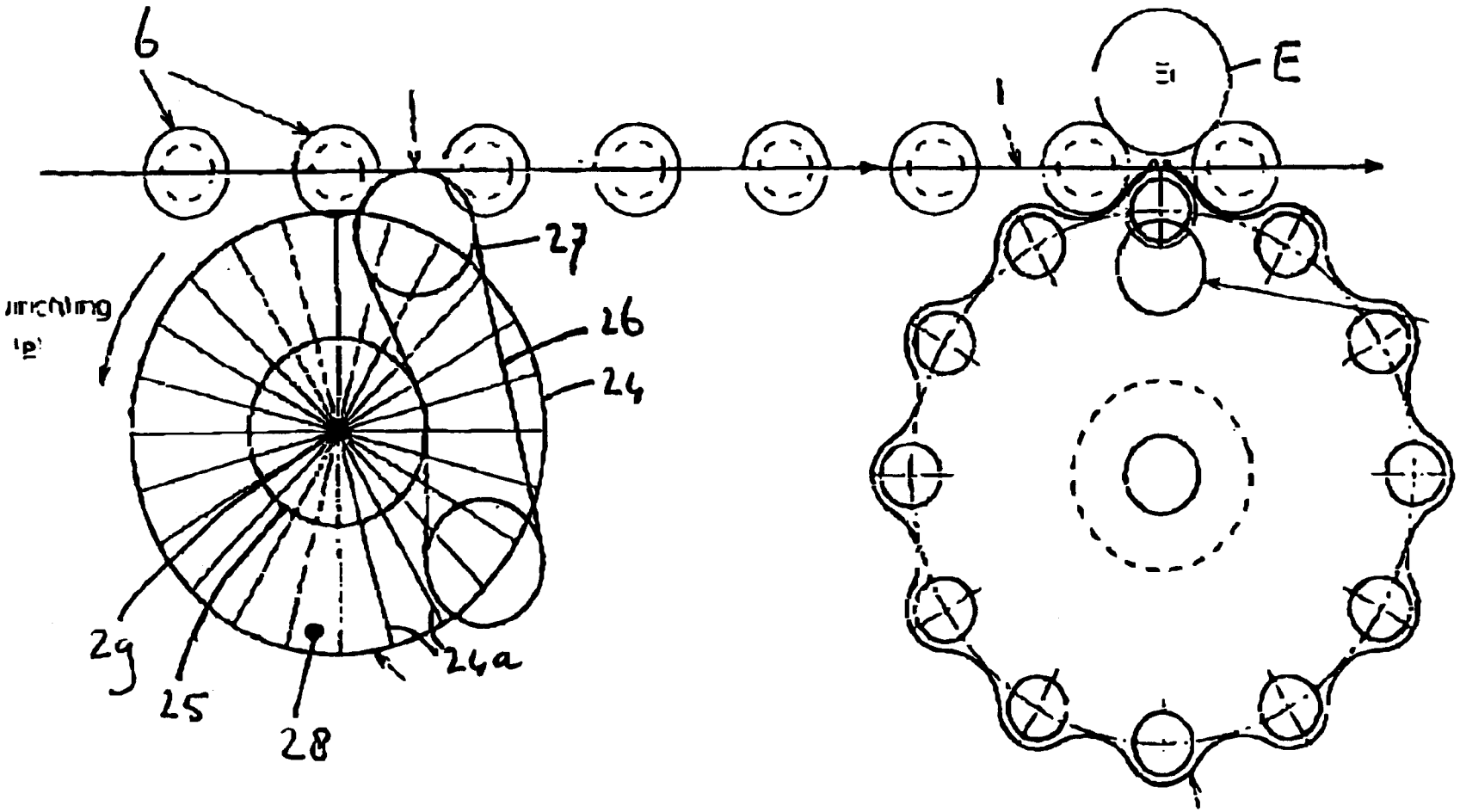
FIG. 8 shows a side elevation of the roller conveyor with a brush and a suction device arranged under the conveyor.

FIG. 8 shows a side elevation view of the roller conveyor 1. The nozzles 2, 3 above the conveyor 1 are not shown for clarity reasons. Under the roller conveyor 1, having rollers 6, a rotatable brush 24 is arranged such that the brush contacts an underside of the conveyor rollers 6 for removing water therefrom. The brush 24 is rotatable around an axis 29 which is parallel to the axes of the rollers 6 of the conveyor 1. The brush 24 is driven by a sprocket 25, which is driven by a chain 26, which in turn is driven by a driving sprocket 27 which in turn is driven by the conveyor 1. Preferably, the brush 24 rotates in a direction, such that the direction of movement of the brush 24 near the conveyor 1 is contrary to the direction of movement of the conveyor 1. Also shown is a wipe bar 28 which is arranged such that brush hairs 24*a* of the brush wipe against the wipe bar 28 for wiping off the water from the brush 24 The brush 24 may be mounted perpendicularly under or downstream of a first drying section. It is preferred that the rollers 6 of the conveyor 1 do not rotate when upstream of the brush 24 and at the brush 24. When the rollers 6 do not rotate, the water on the rollers will all be gathered at the lowest point of the roller 6. Exactly these lowest points are wiped off by the brush 24. Downstream of the brush 24, it is preferred that the rollers 6 are being rotated such that the eggs rotate when they pass a second drying section. It will be clear that in stead of one brush 24, two or more brushes are also possible. In the right part of FIG. 8, downstream of the brush 24, a suction device as described with reference to FIGS. 6 and 7 is mounted under the conveyor 1.

Optionally, between the rollers 6 located on one shaft 5, air guiding profiles could be arranged for guiding the blown-out drying air around the egg E. In that way, a still faster drying of the eggs can be accomplished.

It will be understood that the invention is not limited to the exemplary embodiment described, but that various alterations are possible within the scope of the invention. Thus, use could be made of nozzles having a curved outflow opening of a total length corresponding approximately to the length of the largest egg that may occur, the curved outflow opening thereby following approximately the curvature of the ellipsoid product, so that the drying air blown out thereby is both directed substantially perpendicularly to the surface of the product and blows directly upon the points of the ellipsoid product. It will be understood that the apparatus is also suitable for drying ellipsoid fruit products, such as lemons, kiwis and the like. Although in the present exemplary embodiments the nozzles are fixedly arranged, a movable arrangement of the nozzles is also possible.

What is claimed is:

1. An apparatus for drying substantially ellipsoid products which are conveyed over a conveying path by means of a roller conveyor having rotatable rollers for supporting the ellipsoidal products, the rollers being drivable for rotation, the apparatus comprising a first number of nozzles which are connected to a compressor forming a first drying section, wherein at least one rotating brush is arranged under the conveyor such that the at least one brush contacts an underside of the conveyor for removing water therefrom, and wherein the rotational speed of the rollers and the distance of the nozzles are adjusted to each other such that each product, after passing the nozzles does not have any surface portion, at least adjacent the points, that haven't been subjected to direct blowing by drying air from one of the nozzles.

2. An apparatus according to claim 1, wherein the rollers are not rotated when passing the first drying section.

3. An apparatus according to claim 1, wherein the rotating brush is rotatable around an axis which parallel to an axis of rotation of the rollers of the conveyor.

4. An apparatus according to claim 1, wherein the brush is arranged downstream of the first drying section.

5. An apparatus according to claim 1, wherein the brush is arranged perpendicularly under the first drying section.

6. An apparatus according to claim 1, wherein the amount of drying air blown out by the nozzles is about 150 $m^3$ per 1000 products per hour.

7. An apparatus according to at least claim 1, wherein the overpressure of the compressor lies in the range of from 100 to 500 mbar (=10,000–50,000 Pa).

8. An apparatus according to claim 1, wherein it comprises a heating element arranged for heating the air to be blown out by the nozzles.

9. An apparatus for drying substantially ellipsoid products which are conveyed over a conveying path by means of a conveyor, the apparatus comprising a first number of nozzles which are connected to a compressor forming a first drying section, wherein at least one rotating brush is arranged under the conveyor such that the at least one brush contacts an underside of the conveyor for removing water therefrom; and a wipe bar arranged parallel to the brush, such that brush hairs of the brush wipe against the wipe bar for wiping off the water from the brush.

10. An apparatus for drying substantially ellipsoid products which are conveyed over a conveying path by means of a conveyor, the apparatus comprising a first number of nozzles which are connected to a compressor forming a first drying section, and a second number of nozzles connected to a compressor forming a second drying section downstream of the first drying section, wherein at least one rotating brush is arranged under the conveyor such that the at least one brush contacts an underside of the conveyor for removing water therefrom.

11. An apparatus according to claim 10, wherein between the first and the second drying section, viewed in the conveying direction, there is a certain distance, which is such that the water still present after the first drying section is redistributed over the eggs.

12. An apparatus for drying substantially ellipsoid products which are conveyed over a conveying path by means of a conveyor, the apparatus comprising a first number of nozzles which are connected to a compressor forming a first drying section, suction openings provided under the conveyor and connected to a suction pump for creating a reduced pressure under the conveyor, wherein at least one rotating brush is arranged under the conveyor such that the at least one brush contacts an underside of the conveyor for removing water therefrom.

13. An apparatus according to claim 12, wherein the suction openings are provided in tubes which are rotatably arranged and which in an upper rotational position are brought into fluid communication with a reduced pressure source and in another rotational position are brought into fluid communication with an overpressure source.

14. An apparatus for drying substantially ellipsoid products which are conveyed over a conveying path by means of a conveyor, the apparatus comprising a first number of nozzles which are connected to a compressor forming a first drying section;

a second number of nozzles which are connected to a compressor forming a second drying section downstream of the first drying section;

at least one rotating brush being arranged under the conveyor such that the at least one brush contacts an underside of the conveyor for removing water therefrom, the at least one brush being arranged perpendicular under the first drying section; and suction openings provided under the converyor and connected to a suction pump for creating a reduced pressure under the conveyor, the suction openings being arranged perpendicular under the second drying section.

15. An apparatus for drying substantially ellipsoid products which are conveyed over a conveying path by means of a conveyor, the apparatus comprising a first number of nozzles which are connected to a compressor forming a first drying section, wherein at least one rotating brush is arranged under the conveyor such that the at least one brush contacts an underside of the conveyor for removing water therefrom; second number of nozzles connected to a compressor forming a second drying section downstream of the first drying section; and suction openings provided under the conveyor and connected to a suction pump for creating a reduced pressure under the conveyor, wherein the at least one brush is arranged downstream of the first and upstream of the second drying section.

16. Apparatus according to claim 15, the suction openings being arranged downstream of the first and upstream of the second drying section and downstream of the at least one brush.

17. Apparatus according to claim 15, the suction openings being arranged perpendicular under the second drying section.

18. An apparatus according to claim 15, wherein the length of the drying sections, viewed in the conveying direction, is about 800 mm, while the distance between the two drying sections is about 500 mm.

19. An apparatus for drying substantially ellipsoidal products which are conveyed over a conveying path by means of a conveyor, the apparatus comprising a first number of nozzles which are connected to a compressor forming a first drying section, the nozzles being designed and arranged relative to the conveyor path such that the drying air blown out by these nozzles has a main flow direction which is both directed substantially perpendicularly to the surface of a passing product and blows directly onto at least the areas adjacent the point of a passing ellipsoid product, and at least one rotating brush arranged under the conveyor such that the at least one brush contacts an underside of the conveyor for removing water therefrom.

20. Apparatus according to claim 19, wherein the nozzles are arranged immovably.

21. Apparatus according to claim 19, wherein the nozzles are arranged movably.

22. Apparatus according to claim 19, wherein the conveyor is a roller conveyor comprising rotatable rollers for supporting the ellipsoid products.

23. An apparatus according to claim 22, wherein the rollers, for the purpose of their rotation, are driven such that the movement of the upwardly facing side of the products relative to the conveyor, which movement arises as a result of the rotation, has a direction which is equal to the conveying direction of the conveyor.

24. An apparatus according to at least claim 23, wherein each shaft of the conveyor that is provided with rollers comprises a gear wheel, the conveyor being provided, at least adjacent the drying apparatus, with a gear rack which engages the upwardly facing side of the gear wheels.

25. An apparatus according to any one of claims 22, wherein on opposite sides obliquely above each row of rollers of the roller conveyor extending in the conveying direction, nozzles are arranged, the main flow direction of the drying air blown out by the nozzles including an angle with the rotation axis of the rollers of the roller conveyor which is in the range of 10°–85°.

26. An apparatus according to claim 25, wherein the nozzles which, viewed in the conveying direction, are arranged on the left above a given row of rollers, are arranged so as to be staggered in the conveying direction relative to the nozzles which, viewed in the conveying direction, are arranged on the right above a given row of rollers.

27. An apparatus according to claim 26, wherein the roller conveyor comprises a plurality of rows of rollers extending in the conveying direction, while the nozzles which, viewed in a direction transverse to the conveying direction and parallel to the plane of conveyance, are located in one line, all blow to the same side, and the nozzles succeeding each other in the conveying direction, lying in one line in transverse direction, alternately blow to the left and to the right.

28. An apparatus according to claim 22, wherein the rollers are drivable for rotation, the rotational speed of the rollers and the distance of the nozzles being adjusted to each other such that each product, after passing the nozzles, does not have any surface portion, at least adjacent the points, that has not been subject to direct blowing by drying air from one of the nozzles.

29. An apparatus according to claim 22, Wherein between the rollers located on one shaft, air guiding profiles are arranged which guide blown drying air around the product.

30. An apparatus for drying substantially ellipsoid products which are conveyed over a conveying path by means of a conveyor, the apparatus comprising a first number of nozzles which are connected to a compressor forming a first drying section, the nozzles being freely arranged and each provided with a substantially rectangular outflow opening of about 1×10 mm, wherein at least one rotating brush is arranged under the conveyor such that the at least one brush contacts an underside of the conveyor for removing water therefrom.

31. An apparatus according to claim 30, wherein the longitudinal direction of the outflow opening lies in an imaginary vertical plane which extends substantially perpendicularly to the conveying direction of the conveyor.

32. An apparatus according to claim 2, wherein between the rollers located on one shaft, air guiding profiles are arranged which guide blown drying air around the product.

* * * * *